US009390605B2

(12) United States Patent
Schmid

(10) Patent No.: US 9,390,605 B2
(45) Date of Patent: Jul. 12, 2016

(54) AUXILIARY DEVICE FOR A HAZARD ALARM CONSTRUCTED AS A POINT TYPE DETECTOR FOR FUNCTION MONITORING OF THE HAZARD ALARM, AND AN ARRANGEMENT AND METHOD OF MONITORING USING A DEVICE OF THIS KIND

(71) Applicant: SIEMENS SCHWEIZ AG, Zurich (CH)

(72) Inventor: Beat Schmid, Winterthur (CH)

(73) Assignee: Siemens Schweiz AG, Zurich (CH)

( * ) Notice: Subject to any disclaimer, the term of this patent is extended or adjusted under 35 U.S.C. 154(b) by 6 days.

(21) Appl. No.: 14/554,420

(22) Filed: Nov. 26, 2014

(65) Prior Publication Data

US 2015/0145684 A1 May 28, 2015

(30) Foreign Application Priority Data

Nov. 27, 2013 (EP) ..... 13194735

(51) Int. Cl.
*G08B 17/10* (2006.01)
*G08B 17/107* (2006.01)
*G08B 29/04* (2006.01)

(52) U.S. Cl.
CPC ..... *G08B 17/10* (2013.01); *G08B 17/107* (2013.01); *G08B 29/043* (2013.01)

(58) Field of Classification Search
CPC ..... G08B 29/145; G08B 29/046
USPC ..... 340/628, 629, 630, 693.5, 693.6, 340/693.11, 693.12
See application file for complete search history.

(56) References Cited

U.S. PATENT DOCUMENTS 5,247,283 A * 9/1993 Kobayashi ..... G08B 29/145 340/628
7,791,475 B2 * 9/2010 Clow ..... G08B 17/10 340/506
8,514,074 B2 * 8/2013 Egawa ..... G08B 29/145 340/540
8,587,442 B2 11/2013 Loepfe et al.
2009/0243843 A1 10/2009 Clow
2011/0123035 A1 * 5/2011 Pfannenberg ..... G08B 29/10 381/59

FOREIGN PATENT DOCUMENTS

DE 102009047531 A1 6/2011
EP 2093734 A1 8/2009
EP 2492882 A1 8/2012

* cited by examiner

*Primary Examiner* — Toan N Pham
(74) *Attorney, Agent, or Firm* — Laurence Greenberg; Werner Stemer; Ralph Locher

(57) ABSTRACT

An auxiliary device for a hazard alarm constructed as a point type detector, in particular for a smoke alarm or smoke gas alarm. The device is a separate unit that can be attached to the hazard alarm and is provided to monitor the function thereof. It has a transmitting unit and/or a receiving unit for the detection of objects in the vicinity of the hazard alarm. The auxiliary device monitors smoke inlet openings of the hazard alarm. An arrangement containing the hazard alarm and the auxiliary device attached thereto and matched thereto in terms of construction and/or connections is also provided. The auxiliary device of this kind is used for monitoring the vicinity of the hazard alarm for current-shielding objects, for monitoring an inlet opening of the hazard alarm for contamination and optionally for monitoring the function of an acoustic alarm signaling device of the hazard alarm.

15 Claims, 6 Drawing Sheets

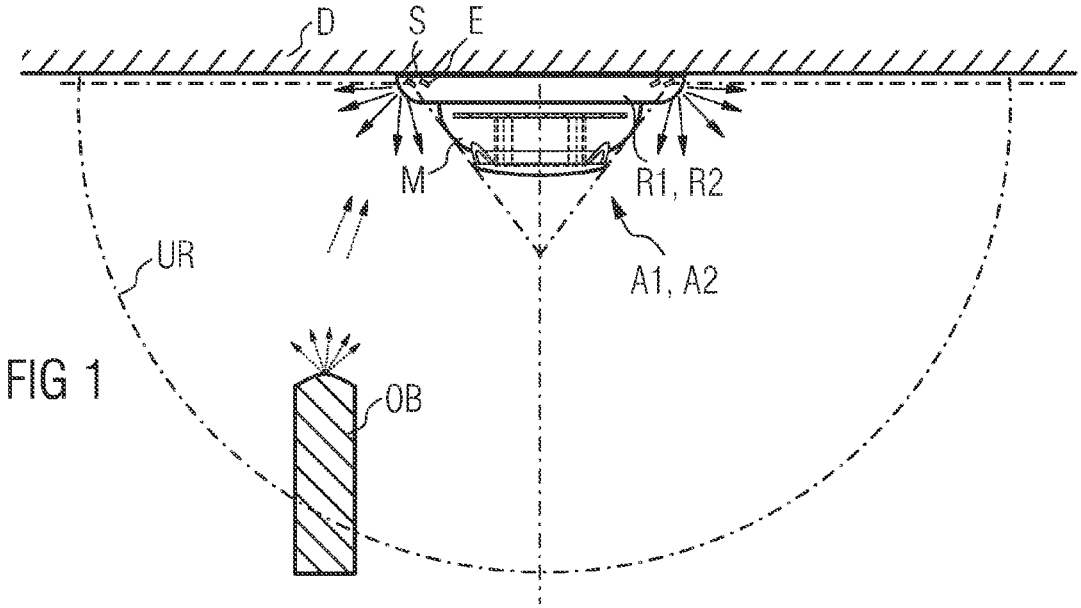
FIG 1
FIG 2
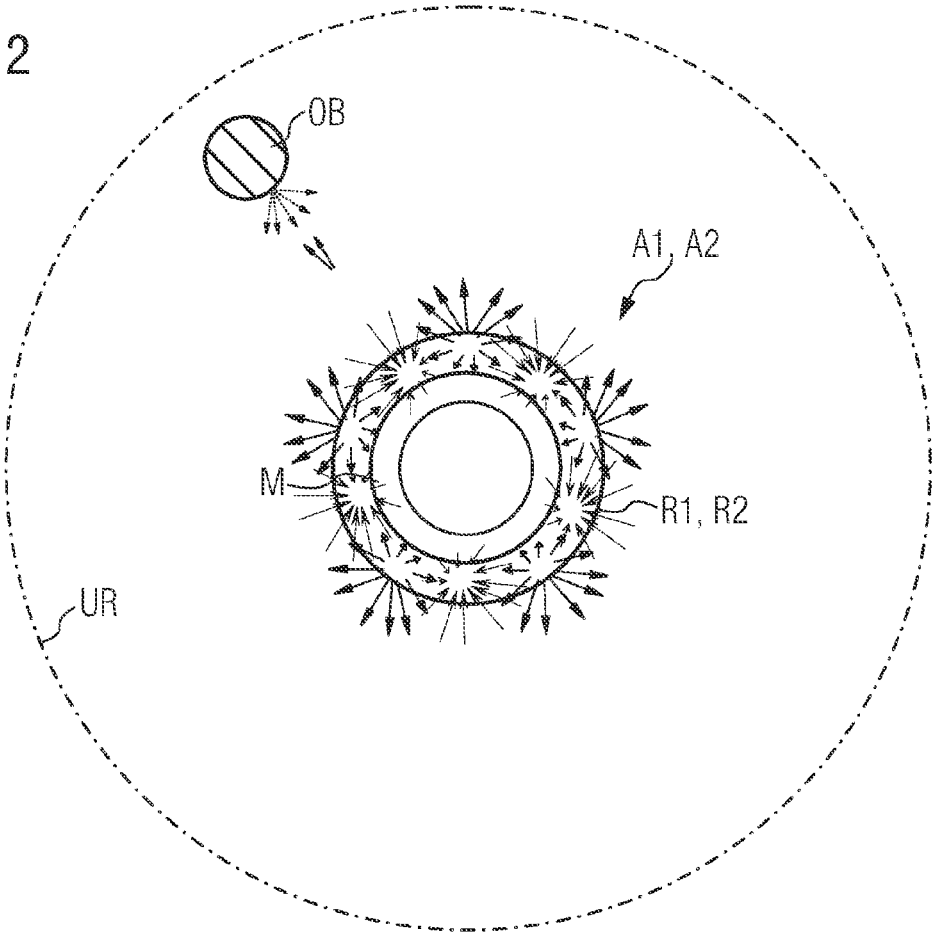

AUXILIARY DEVICE FOR A HAZARD ALARM CONSTRUCTED AS A POINT TYPE DETECTOR FOR FUNCTION MONITORING OF THE HAZARD ALARM, AND AN ARRANGEMENT AND METHOD OF MONITORING USING A DEVICE OF THIS KIND

CROSS-REFERENCE TO RELATED APPLICATION

This application claims the priority, under 35 U.S.C. §119, of European application EP 131 94 735.0, filed Nov. 27, 2013; the prior application is herewith incorporated by reference in its entirety.

BACKGROUND OF THE INVENTION

Field of the Invention

The invention relates to an auxiliary device for a hazard alarm constructed as a point type detector for function monitoring of the hazard alarm. The hazard alarm is in particular a smoke alarm or smoke gas alarm.

The invention also relates to an arrangement containing a hazard alarm constructed as a point type detector and containing an auxiliary device matched thereto in terms of construction and/or connections and attached to the hazard alarm.

Finally the invention relates to a use of an auxiliary device of this kind for monitoring the vicinity of the hazard alarm for current-shielding objects, for monitoring at least one inlet opening of the hazard alarm for contamination and optionally for monitoring the function of an acoustic alarm signaling device of the hazard alarm.

The hazard alarms being considered are preferably smoke alarms, smoke gas alarms or smoke detectors. Hazard alarms of this kind typically have an optical detector unit that operates according to the scattered light principle for the detection of smoke particles. Alternatively or additionally they can have a detector unit that operates according to the acousto-optic principle or a gas sensor for the detection of gases typically involved in a fire. Hazard alarms of this kind can also have a temperature sensor for the detection of inadmissibly high temperatures in the vicinity of the hazard alarm.

The hazard alarms being considered can also be connected in terms of signaling and/or data by a shared detector cable or detector line, in particular by a two-wire cable, to a hazard receiving station. Alternatively or additionally they can have an autonomous power supply, such as a battery. Hazard alarms of this kind can also have a radio module for the transmission of an alarm signal, a warning signal or status information to a neighboring hazard alarm or to a hazard receiving station. They can also be adapted to pass an alarm signal, warning signal or status information transmitted by a neighboring hazard alarm by radio to a neighboring hazard alarm or to a hazard receiving station within the sense of a routing.

According to standard DIN 14676 "Smoke alarm devices for use in residential buildings, apartments and rooms with similar purposes—installation, use and maintenance" should be checked at least once a year by way of a mandatory visual and functional testing. On the one hand the object of the check is that there are no disruptive objects in the vicinity of the smoke alarm, such as in an area of half a meter around the hazard alarm, which could cause current shielding for the smoke to be detected in the event of a fire. If, on the other hand, there are inlet openings in the housing of such a hazard alarm then the permeability of these inlet openings to smoke or smoke gas should be regularly checked. The checking of such smoke alarms can also occur automatically.

SUMMARY OF THE INVENTION

Starting from the prior art mentioned in the introduction it is an object of the invention to disclose a device which simplifies automated regular checking of hazard alarms of this kind. It is also an object of the invention to disclose a device which enables easy subsequent function monitoring of a hazard alarm, in particular a smoke alarm, compliant with relevant standards. Finally it is an object of the invention to disclose a suitable arrangement with a device of this kind and a suitable use of a device of this kind.

The object of the invention is achieved by an auxiliary device for a hazard alarm constructed as a point type detector. According to the invention the auxiliary device is a separate unit which can be attached to the hazard alarm and provided for function monitoring of the hazard alarm. The device has at least one transmitting unit and/or receiving unit for the detection of objects in the vicinity of the hazard alarm.

The crux of the invention is that a conventional hazard alarm, in particular a smoke alarm, which does not have automatic function monitoring for current-shielding objects in its vicinity, can be subsequently retrofitted with this function. A first alarm can then be output in the event of a detected object in the vicinity of the hazard alarm. This can occur for example by controlling an optical and/or acoustic display unit on the auxiliary device itself and/or via radio to a higher-order hazard receiving station.

According to one embodiment the device can have a central receptacle, in particular a base, for receiving the hazard alarm. The hazard alarms constructed as point type detectors are typically constructed for in particular detachable assembly on a base or detector base. This simplifies assembly complexity significantly.

It is particularly advantageous if the auxiliary device forms a detector base that is compatible in terms of construction and optionally in terms of connections.

"In terms of connections" is taken to mean that an electrical contact is made with alarm contacts of the received hazard alarm. Hazard alarms for smoke detection, which are used in the commercial sector, are typically not adapted to output an acoustic alarm. Instead they are adapted for operation on a shared detector cable or detector line, in particular on a two-wire cable. An alarm ascertained by the hazard alarm or a warning is then transmitted via this detector cable in terms of signaling and/or data to a connected higher-order hazard receiving station. The electrical power supply of the connected hazard alarm is also provided via this detector cable, which is also called a detector bus. Hazard alarms of this kind are conventionally also called smoke alarms, in contrast to smoke detectors with acoustic alarm output in the non-commercial sector to standard DIN 14676.

Electrical contacting of the received hazard alarm on the inventive auxiliary device or attaching the inventive auxiliary device to a hazard alarm of this kind makes data communication with the received hazard alarm possible. The inventive auxiliary device can exhibit the function of a hazard receiving station or act like a hazard receiving station. Alternatively or additionally an electrical power supply of the received hazard alarm may also be provided by the contacted auxiliary device.

Alternatively or additionally the auxiliary device can have a base receptacle compatible in terms of construction and optionally in terms of connections to secure the auxiliary device to a detector base for simplified assembly.

If the auxiliary device has a base or detector base for a hazard alarm to be received, and a preferably opposing base receptacle for assembly of the auxiliary device on a base, then an auxiliary device of this kind can also be called a "base".

The inventive auxiliary device is preferably annular or ring segment-shaped or polygonal. An auxiliary device of this kind can therefore also be called an auxiliary ring. The auxiliary device preferably projects slightly "beyond" in the lateral direction, such as in a range of 1 cm to 5 cm. "Lateral" designates directions away from a constructional main axis of the received hazard alarm. Since most of the known hazard alarm is substantially rotationally symmetrical, the auxiliary device preferably also extends in the radial direction beyond the outer lateral dimensions of the hazard alarm, such as in a range of 1 cm to 5 cm. In this case hazard alarm and auxiliary device have a shared constructional main axis or axis of symmetry.

According to one embodiment that is an alternative to the previous embodiment the device is constructed for lateral bordering of the hazard alarm. The device can consequently be placed on the hazard alarm, which has already been assembled, without covering it. The internal contour of the auxiliary device is preferably matched to the lateral external contour of the hazard alarm that is to be laterally bordered.

According to a further embodiment the device has a plurality of transmitting units and/or receiving units distributed around the hazard alarm in the circumferential direction in an outer region at a lateral distance from the hazard alarm. Complete or at least virtually complete monitoring of the vicinity of the hazard alarm for current-shielding objects is possible as a result. The transmitting units and/or receiving units are preferably uniformly distributed in the circumferential direction.

According to a further embodiment the device has a plurality of distributed transmitting and receiving units and an evaluation unit connected thereto. The evaluation unit is adapted to control the respective transmitting units for emitting a signal in the vicinity of the hazard alarm. It is also adapted to evaluate in terms of time a respective signal originating from the receiving units that is reflected at objects in the vicinity of the hazard alarm. The evaluation unit is adapted, moreover, to output a first alarm signal if a detected object is located within a predefined distance of the hazard alarm and if the reflected signal exceeds a predefined minimum level. It is possible to ascertain the distance of an object from the hazard alarm in accordance with the echo principle by way of an evaluation in terms of time.

The evaluation unit can also be adapted to weight the respective received reflected signals. Reflected signals from objects which are located closer to the hazard alarm can be weighted higher than objects at the margins of the monitored vicinity. The evaluation unit is preferably adapted to output the first alarm signal only if an object is permanently detected within the monitored vicinity. "Permanently" is taken to mean a minimum period of being present, lasting several minutes, hours or days.

According to one embodiment the at least one transmitting unit is an optical transmitting unit, such as an LED, in particular an infrared light emitting LED, and the at least one receiving unit is an optical receiving unit, in particular a photodiode spectrally sensitive thereto. Both units may be combined to form one unit.

Alternatively or additionally the at least one transmitting unit can be an acoustic transmitting unit, such as an ultrasonic transmitter, and the at least one receiving unit can be an acoustic receiving unit, in particular an ultrasonic receiver. Both units may also be combined to form one unit as an ultrasonic transceiver.

Alternatively or additionally the at least one transmitting unit can be a microwave transmitter and the at least one receiving unit can be a microwave receiver. Both units can also be combined to form a radar unit.

According to a further embodiment the device has an optical scanning device for one or more inlet opening(s) of a received or bordered hazard alarm. It also has an evaluation unit connected thereto, i.e. connected thereto in terms of data or signaling. The evaluation unit is adapted to output a second alarm signal in the event of detected inadmissible contamination. Scanning preferably occurs optically and in particular with infrared light. Optical scanning of the inlet opening occurs outside of the received hazard alarm, i.e. from the outside.

In particular the optical scanning device has a light transmitter, in particular an infrared LED, for emitting a highly bundled light beam. The light transmitter is oriented in such a way that its light beam passes the at least one inlet opening at a slight distance. "Slight" is preferably taken to mean a distance value from the inlet opening in the range of 1 mm to 10 mm. The optical scanning device also has a light receiver, in particular a photodiode for infrared light. It is provided and oriented to receive scattered light from contamination from the region of the at least one inlet opening. The evaluation unit connected to the light transmitter and light receiver is adapted to output a second alarm signal if a received signal originating from the light receiver exceeds a predefined minimum level. In other words, the second alarm signal is output if sufficient scattered light from the contamination can be detected in front of the inlet opening.

As an alternative to the preceding embodiment the optical scanning device can have a plurality of light transmitters, in particular infrared LEDs, each for emitting a highly bundled light beam. The respective light transmitter is oriented in such a way that its light beam passes at least one inlet opening at a slight distance. "Slight" is preferably again taken to mean a distance value from the inlet opening in the range of 1 mm to 10 mm. The optical scanning device has a plurality of light receivers, in particular for infrared light sensitive photodiodes, for receiving scattered light from contamination from the region of the at least one inlet opening. The evaluation unit connected to the light transmitters and light receivers is adapted to evaluate the received signals originating from the respective light receivers and to output a second alarm signal if the result of evaluation exceeds a predefined reference value. Emitting of the second alarm signal is advantageously avoided thereby if only one received signal exceeds a minimum level. The second alarm signal is preferably only output if half or most of the available received signals exceeds the minimum level.

According to a particular embodiment the device has a contact-based and/or wireless communications interface for data communication between a control unit of the received hazard alarm and an evaluation unit of the auxiliary device.

The contact-based communications interface can simultaneously be an existing interface of a hazard alarm which is provided for contacting the hazard alarm via its detector contacts on a detector cable or on a detector bus. The contact-based interface can also be a separate interface which makes contact with corresponding counter contacts on the auxiliary device once the hazard alarm has been attached to the auxiliary device.

The wireless communications interface can be e.g. what is referred to as a near field communication (NFC) interface which enables an inductively coupled data transfer to and from a further NFC interface in the received hazard alarm in the range of a few centimeters. Electrical power transmission from the auxiliary device to the hazard alarm in order to supply the hazard alarm with electric power is also possible in this way.

In principle the two communications interfaces enable the evaluation unit of the auxiliary device to access the data of the control unit of the received hazard alarm. Direct access to the output and input units of the hazard alarm is therefore possible with appropriate configuration of the hazard alarm.

According to a further embodiment the device has a plurality of distributed light transmitters for emitting one light bundle in each case. The respective light bundle is directed toward the at least one inlet opening of a received or bordered hazard alarm. The light bundle preferably originates from an infrared LED. The evaluation unit is connected thereto to control the light transmitter and adapted to output a second alarm signal if a light receiving signal, transmitted from the hazard alarm via the communications interface and which originates from a light receiver inside the hazard alarm, falls below a predefined value. The light receiver inside the hazard alarm is preferably simultaneously a light receiver provided for scattered light detection. It is thereby advantageously possible to check the permeability of the at least one inlet opening in the hazard alarm.

According to an advantageous embodiment the device has an acoustic alarm signaling device and/or an alarm flash. The evaluation unit is adapted to receive via the communications interface an alarm signal output in the event of an alarm by the received or bordered hazard alarm in order to control the acoustic alarm signaling device and/or alarm flash in the event of an alarm. The communications interface can be e.g. an existing interface of a hazard alarm which is provided for making contact with the hazard alarm via its detector contacts on a detector cable or on a detector bus.

The auxiliary device also has a device for the acoustic or electrical checking of the acoustic alarm signaling device and/or a device for the visual checking of the alarm flash. In the acoustic case the device can then be a microphone whose output microphone signal is checked by the evaluation unit for the presence of a predefined audio frequency and volume level. Alternatively the device can be an electrical signal detector which checks the presence of electrical excitation signals for the acoustic alarm signaling device. In the visual case the device can be one of the optical receiving units for monitoring the vicinity or one of the light receivers for monitoring contamination.

The device is also adapted to repeatedly monitor the functionality of the acoustic alarm signaling device and/or the alarm flash, e.g. weekly, monthly, quarterly, etc. The evaluation unit is adapted to output a third alarm signal if the acoustic alarm signaling device and/or the alarm flash fails the functional test.

According to a further embodiment the auxiliary device has a radio module, a motion detector, a smoke gas sensor, a temperature sensor, a loudspeaker, an acoustic alarm signaling device, an alarm flash, an emergency light and/or a battery. The range of functions of the inventive auxiliary device can advantageously be expanded by further safety and comfort functions as a result.

The object of the invention is also achieved by an arrangement containing a hazard alarm constructed as a point type detector and an inventive auxiliary device matched thereto in terms of construction and/or connections and attached to the hazard alarm.

The use of an inventive auxiliary device is particularly advantageous for monitoring the vicinity of the hazard alarm for current-shielding objects, for monitoring at least one inlet opening of the hazard alarm for contamination and optionally for monitoring the function of an acoustic alarm signaling device and/or alarm flash of the hazard alarm. The hazard alarm is then a smoke alarm in particular.

Other features which are considered as characteristic for the invention are set forth in the appended claims.

Although the invention is illustrated and described herein as embodied in an auxiliary device for a hazard alarm constructed as a point type detector for function monitoring of the hazard alarm, and an arrangement and method of monitoring using a device of this kind, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a diagrammatic, side view of a first and a second embodiment of an arrangement containing an auxiliary device and a received hazard alarm according to the invention;

FIG. 2 is a top plan view of the arrangement according to FIG. 1;

DETAILED DESCRIPTION OF THE INVENTION

Referring now to the figures of the drawings in detail and first, particularly to FIG. 1 thereof, there is shown a side view of an example of a first and a second embodiment of an arrangement A1, A2 containing an auxiliary device R1, R2 and a received hazard alarm M according to the invention. The illustrated hazard alarm M is configured as a point type detector and in the present example as a smoke alarm. The hazard alarm M is adapted in terms of construction to be attached to the illustrated auxiliary device R1, R2. The two arrangements A1, A2 differ only in that the respective associated inventive auxiliary device R1, R2 is configured for assembly on a base or for base-less assembly on an illustrated ceiling D. The different arrangements A1, A2 are shown in detail in FIGS. 3 to 5.

According to the invention the auxiliary device R1, R2 is a separate unit that can be attached to the hazard alarm M and is provided for functional monitoring of the hazard alarm M. The illustrated auxiliary device R1, R2 has by way of example five transmitting units S and five receiving units E (see FIG. 2) for the detection of objects OB in the vicinity of the hazard alarm M. In the present example a rod-shaped object OB is detected within a predefined semi-spherical monitored area UR around the hazard alarm M. The transmitting units S send signals in the vicinity of the hazard alarm (symbolized by arrows) for this purpose. The signals (symbolized by broken arrows) reflected at the rod-shaped object OB are detected by the receiving units E. An evaluation unit (not shown in this view) of the auxiliary device then ascertains on the basis of the reflected signals whether the detected object is located within the monitored area UR and whether this is capable of causing current shielding of the hazard alarm with respect to smoke detection.

In the present example the transmitting units S and receiving units E are ultrasonic transmitters and ultrasonic receivers. Transmitters and receivers can also be combined to form a unit as an ultrasonic transceiver.

FIG. 2 shows the example according to FIG. 1 in a plan view. It shows a uniformly distributed arrangement of the light transmitters S and the light receivers E in the circumferential direction of the received hazard alarm M. Virtually complete monitoring of the vicinity of the hazard alarm M is possible as a result.

Figure 3:
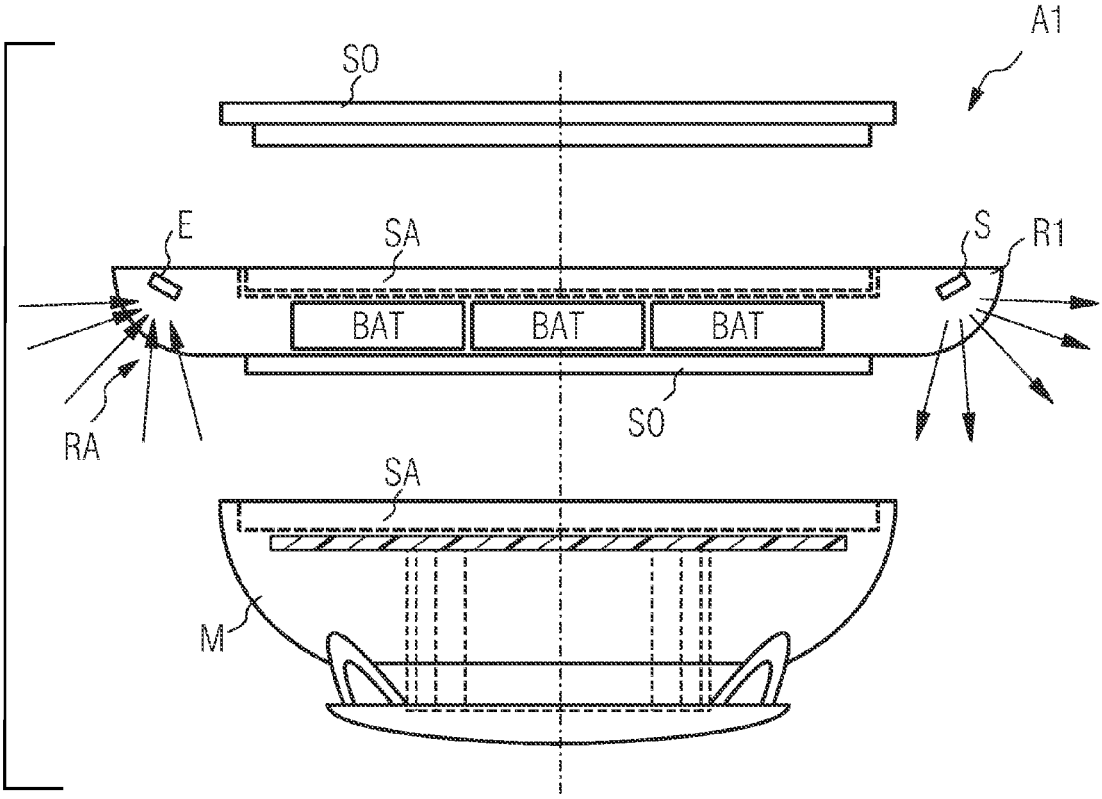
FIG. 3 is an exploded side view of the exemplary first embodiment of the inventive arrangement according to FIG. 1.

FIG. 3 shows the exemplary first embodiment of the inventive arrangement A1 according to FIG. 1 in a detailed view and in an exploded view. In the upper part of FIG. 3 a detector base SO that is known per se can be seen which simplifies assembly of hazard alarms on the ceiling D. Underneath is shown an auxiliary device R1 according to the first embodiment which already enables a base receptacle SA for attachment of the auxiliary device R1 to the base SO. At the same time the auxiliary device R1 has on its opposing side a central receptacle which in terms of construction matches the detector base SO located above. In the present example the smoke alarm M illustrated in the lower part of FIG. 3 can therefore be attached directly to the upper base SO and also to the auxiliary device R1. The inventive auxiliary device R1 can therefore also be called a "base" in accordance with the English term for such devices. In the present example the auxiliary device R1 has a cylindrical or cylindrical-conical construction.

Figure 4:
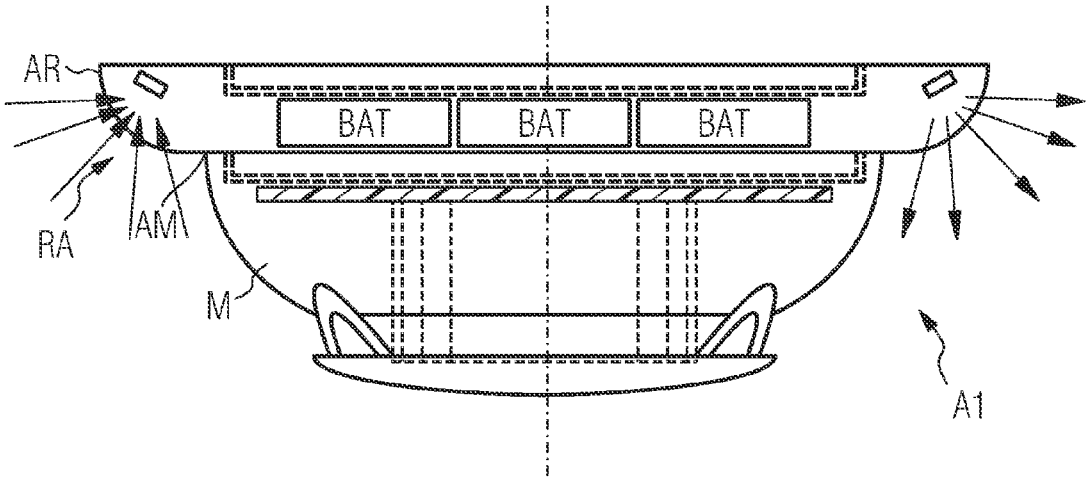
FIG. 4 is a side view according to FIG. 3 in an operative state of the inventive arrangement.

FIG. 4 shows the example according to FIG. 3 in the operative state of the inventive arrangement A1. It can be seen particularly clearly in this view how the auxiliary device R1 monitors the vicinity around the received hazard alarm M for current-shielding objects OB.

In FIG. 4, RA designates a lateral outer region located at a distance from the hazard alarm M and which protrudes by a few centimeters beyond the lateral external contour AM of the received hazard alarm M. AR designates the radial external edge of the auxiliary device R1. BAT designates batteries that are provided for the power supply of the auxiliary device R1. They are used, moreover, for the power supply of the received hazard alarm M via detector contacts (not illustrated further) in the detector base SO.

Figure 5:
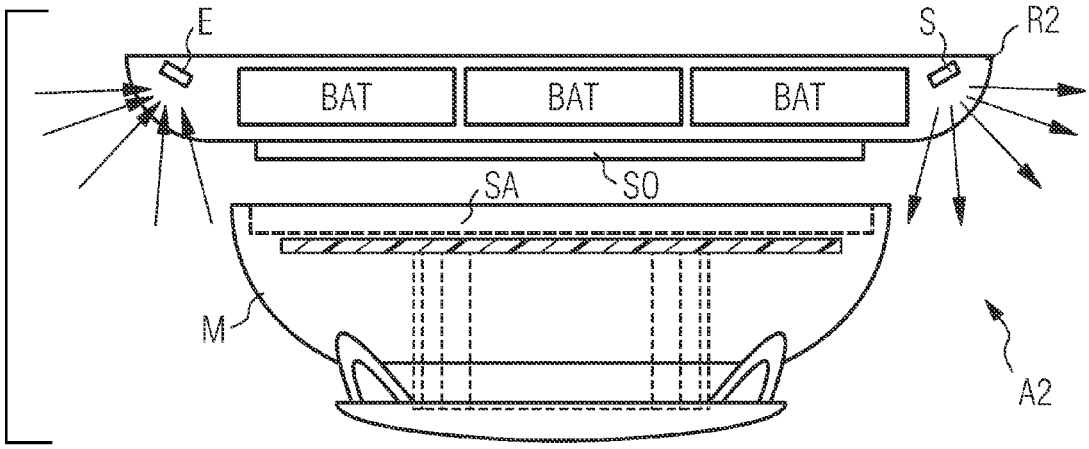
FIG. 5 is an exploded, side view of the exemplary second embodiment of the inventive arrangement according to FIG. 1.

FIG. 5 shows the exemplary second embodiment of the inventive arrangement A2 according to FIG. 1 in a detailed view and in an exploded view. In contrast to FIG. 3, the base receptacle SO is missing here for fastening the auxiliary device R2 e.g. to the ceiling.

Figure 6:
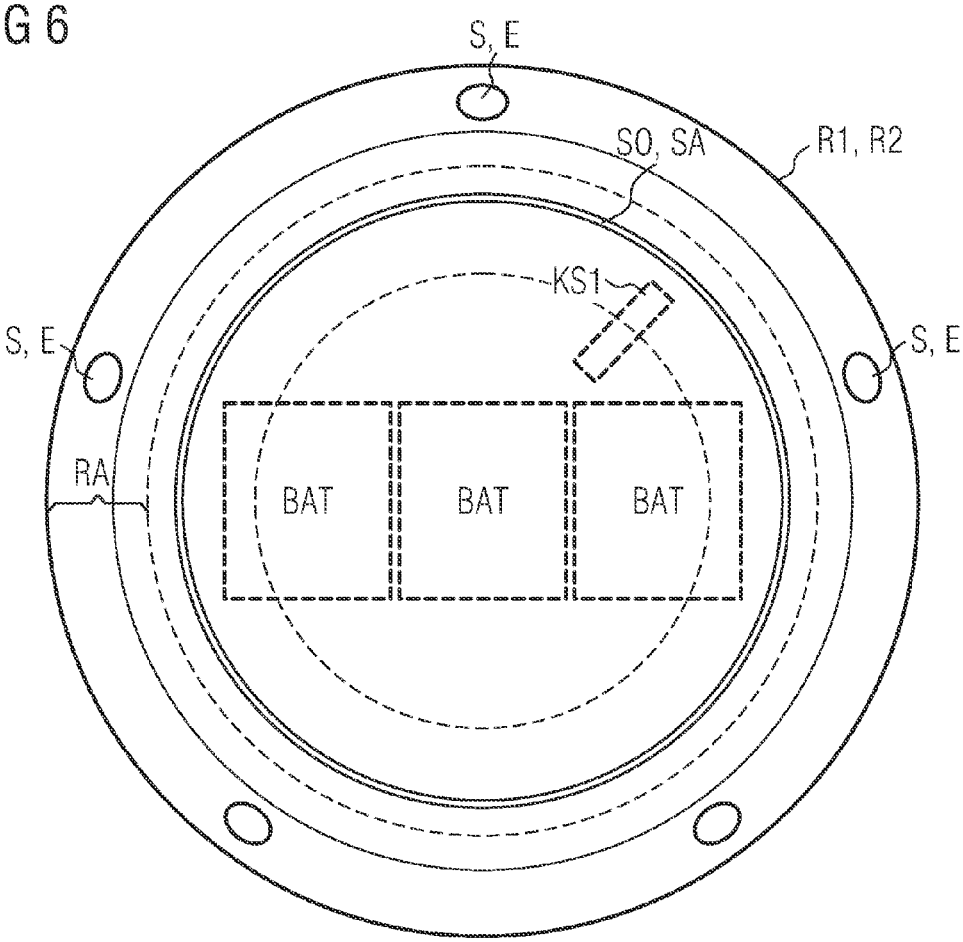
FIG. 6 is a plan view of the second embodiment according to FIG. 4 and FIG. 5.

FIG. 6 shows the example according to FIG. 4 and FIG. 5 in a plan view and in a joint view. The uniform distribution of the transmitting and receiving units S, E combined here to form one unit respectively can be seen in this view. KS1 designates a first communications interface which advantageously corresponds to a detector interface already provided in the received smoke alarm M. On the one hand data transfer between the evaluation unit of the auxiliary device R1, R2 and a control unit of the smoke alarm M is possible via this interface. On the other hand, an electrical power supply of the received smoke alarm M through the auxiliary device R1, R2 is also possible via this interface KS1.

Figure 7:
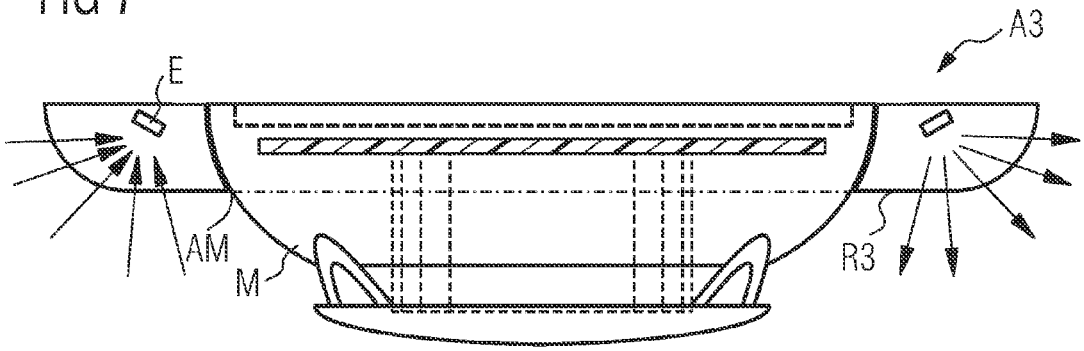
FIG. 7 is a side view of an example of a third embodiment of an arrangement containing the auxiliary device and the bordered hazard alarm according to the invention.

FIG. 7 shows an example of a third embodiment of an arrangement A3 containing an auxiliary device R3 and a bordered hazard alarm M. As FIG. 7 shows, the auxiliary device R1 is now constructed as a ring for lateral bordering of the hazard alarm M. The internal contour of the annular auxiliary device R3 is matched to the lateral external contour AM of the bordered hazard alarm M.

Figure 8:
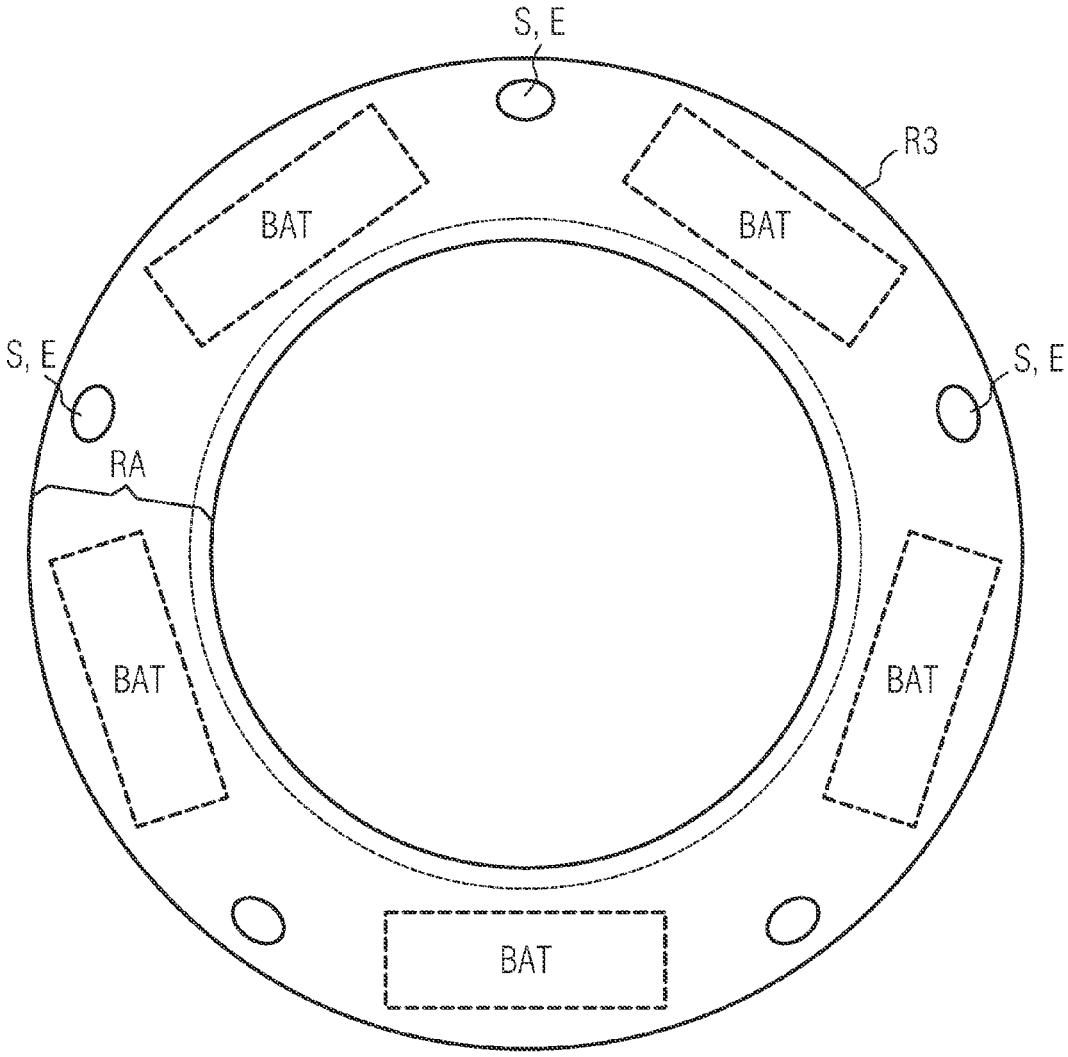
FIG. 8 is a plan view of the example according to FIG. 7.

FIG. 8 shows the example according to FIG. 7 in a plan view. In this view the annular shape of the exemplary auxiliary device R3 can be seen particularly clearly. FIG. 8 also shows a series of batteries for the power supply of the auxiliary device R3. For data transfer the auxiliary device R3 and bordered hazard alarm M can each have a wireless communications interface KS2. First, a data transfer between the evaluation unit of the auxiliary device R3 and a control unit of the smoke alarm M is possible via the wireless communications interface KS2. Second, an electrical power supply of the received smoke alarm M through the auxiliary device R3 is also possible via the interface KS2 in an inductively coupled manner. One circular coil respectively can be arranged in the auxiliary device R3 and in the received hazard alarm M, which coils are preferably concentric to each other, for data transfer and optionally for power transfer. The respective coils can be implemented in the form of strip conductors on a respective circuit board of the auxiliary device and the hazard alarm M.

Figure 9:
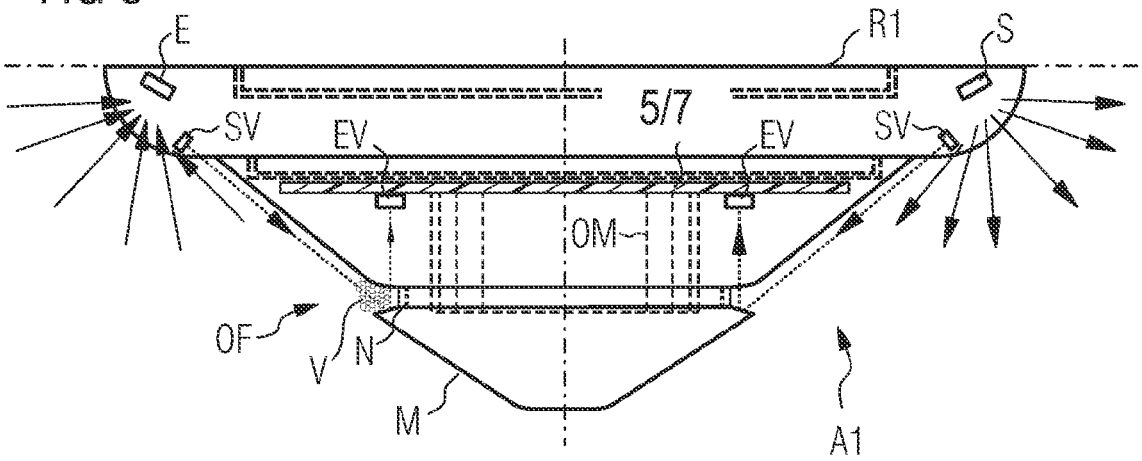
FIG. 9 is a side view of a further example of a first embodiment of the arrangement with a first variant of contamination monitoring according to the invention.

FIG. 9 shows a further example of a first embodiment of the arrangement A1 with a first variant of contamination monitoring according to the invention. The illustrated auxiliary device R1 has for this purpose an optical scanning device SV, EV for an inlet opening OF of the received hazard alarm M and an evaluation unit SER (not illustrated further) connected thereto. The evaluation unit is adapted to output a second alarm signal M2 in the event of detected inadmissible contamination V.

In the present example the device has a plurality of distributed light transmitters SV for emitting one light bundle respectively which is directed toward the at least one inlet opening OF. The evaluation unit is connected to the light transmitters SV to control the light transmitters SV and, moreover, adapted to output a second alarm signal M2 if a light receiving signal, which originates from a light receiver EV inside the hazard alarm M, transmitted from the hazard alarm M via the communications interface falls below a predefined value. As can be seen in the left-hand part of FIG. 9, the light arriving in the inlet opening OF strikes contamination V, so insufficient light reaches the light receiver EV arranged inside the hazard alarm M. This is therefore an indication of inadmissible contamination V in the region of the illustrated inlet opening OF. By contrast, a sufficient quantity of the light emitted by the right-hand light transmitter SV reaches the further light receiver EV inside the hazard alarm M. The associated inlet opening OF is therefore predominantly free from contamination V.

The second alarm signal is preferably suppressed if half or most of the provided received signals on the light receivers EV exceeds the minimum level.

Figure 10:
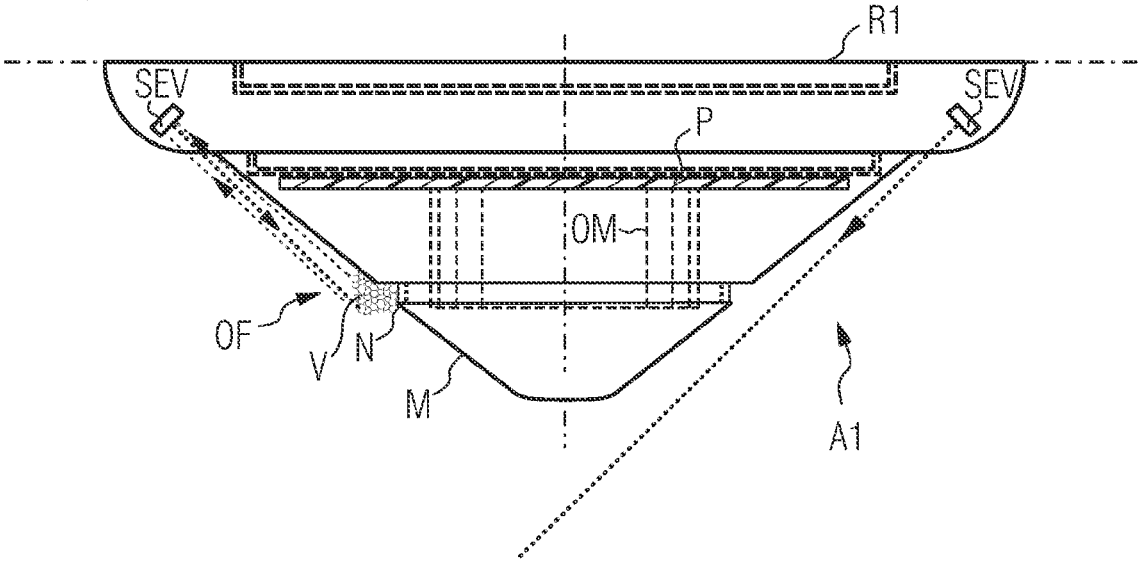
FIG. 10 is a side view of a further example of a first embodiment of the arrangement with a second variant of contamination monitoring according to the invention.

FIG. 10 shows a further example of a first embodiment of the arrangement A1 with a second variant of contamination monitoring according to the invention.

In this case the optical scanning device SEV has a plurality of light transmitters SV each for emitting a highly bundled light beam, with the respective light transmitter SV being oriented in such a way that its light beam passes at least one inlet opening OF at a slight distance. The light transmitter SV is preferably an infrared LED or an infrared laser diode. The optical scanning device SEV also has a plurality of light receivers EV for receiving scattered light from contamination V from the region of the at least one inlet opening OF. The evaluation unit is connected to the light transmitters SV and light receivers EV in terms of signaling. It is, moreover, adapted to evaluate the received signals originating from the respective light receivers EV and to output a second alarm signal M2 if the result of the evaluation exceeds a predefined reference value.

It can be seen in the left-hand part of FIG. 10 how scattered light is detected at the left-hand inlet opening OF whereas in the right-hand part of FIG. 10 the emitted light bundle passes the inlet opening OF that is free from contamination V. Consequently it is not possible to detect an appreciable scattered light signal by way of the associated light receiver in the auxiliary device R1. In the present example a light transmitter and a light receiver are each implemented as a joint component SEV.

Figure 11:
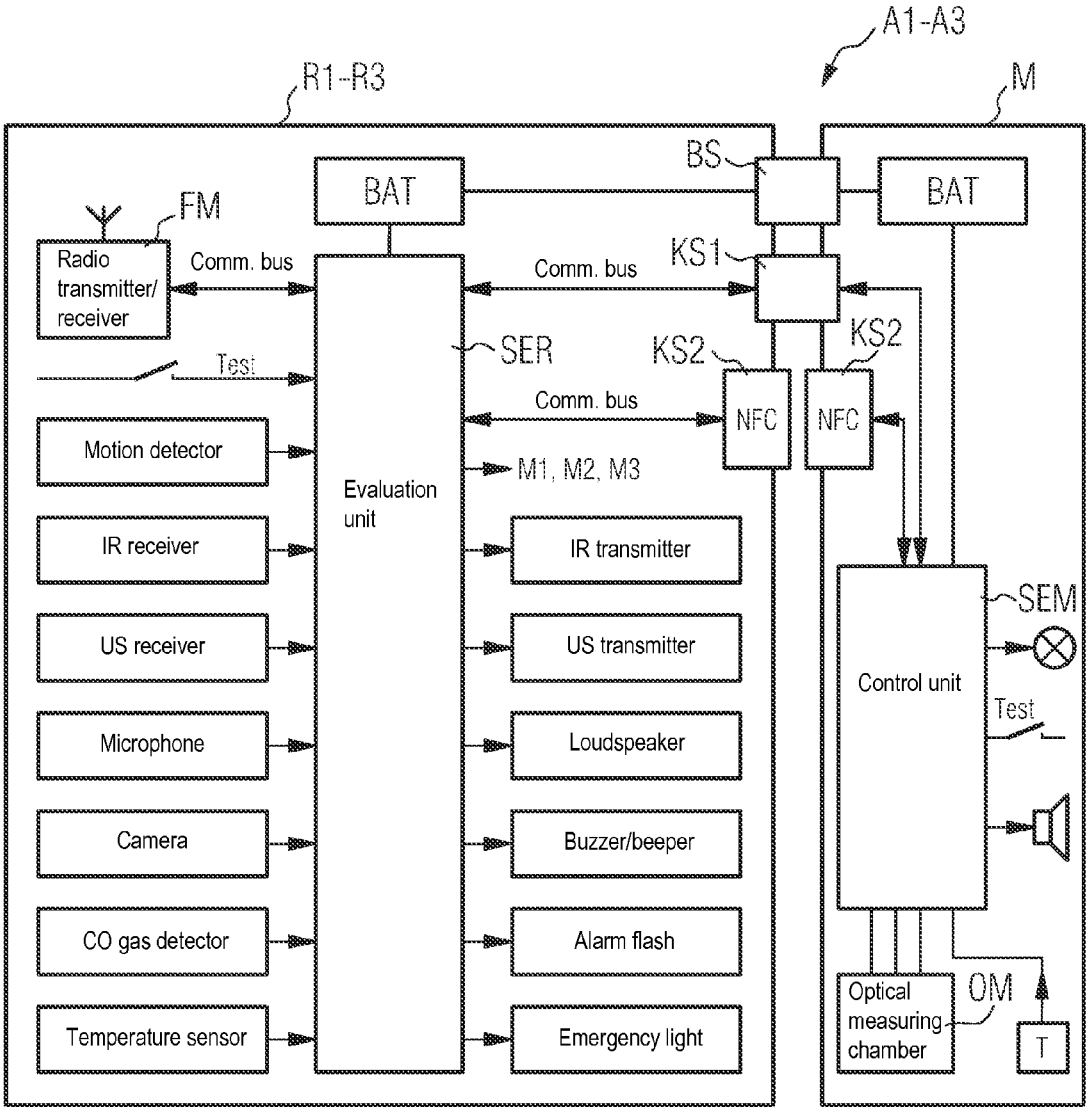
FIG. 11 is a block diagram for all the embodiments and contains the exemplary auxiliary device with a range of possible expansion modules and having the hazard alarm according to the invention.

FIG. 11 shows an exemplary flow chart for all arrangements A1-A3 containing an exemplary auxiliary device R1-R3 with a series of possible expansion modules and a hazard alarm M according to the invention.

The inventive auxiliary device R1-R3 typically has a microcontroller as an evaluation unit SER. It typically also has a number of digital and analogue input and output channels.

The auxiliary device R1-R3 can have e.g. a radio module FM which is connected by a communications bus to the evaluation unit. The first to third alarm signals M1-M3 can be output via this bus, e.g. to a higher-order hazard receiving station. Changes can be made to the firmware of the evaluation unit SER or operating parameters adjusted for example by reversing the procedure.

The auxiliary device R1-R3 can have a manual button on the outer side for testing the auxiliary device R1-R3 or the connected hazard alarm M.

The auxiliary device R1-R3 can also have a motion detector to detect e.g. the presence of people. An alarm signal can optionally be transmitted via the radio module FM if the auxiliary device R1-R3 is switched into a mode for monitoring for burglars, such as by the manual button.

The auxiliary device R1-R3 can also have a microphone for monitoring an acoustic alarm signaling device. The microphone can also be used for room monitoring within the sense of a baby monitor.

The auxiliary device R1-R3 can also have a camera. This can be used as a receiving unit for the detection of current-shielding objects in the vicinity of the hazard alarm, such as by comparing previous images.

The auxiliary device R1-R3 can also have a CO gas detector. An alarm or warning signal can then be output when elevated CO values are detected.

The auxiliary device R1-R3 can also have a temperature sensor. An alarm signal can likewise be output in the case of a detected high temperature.

The auxiliary device R1-R3 can have a loudspeaker for emitting stored voice alarm signals in the event of an alarm. Depending on the alarm signals M1-M3 an alarm signal "Please remove objects in the vicinity of the hazard alarm", "Please remove contamination from hazard alarm" or "Please check hazard alarm" can be output for example.

The inventive auxiliary device R1-R3 can also have an emergency light. This can have a plurality of white LEDs. The emergency light can be switched on for orientation e.g. at night in the event of a fire.

The right-hand part of FIG. 11 schematically shows the construction of a hazard alarm M. SEM designates the control unit of the hazard alarm M. It is typically also a microcontroller. The hazard alarm M can have e.g. a battery BAT for a self-sufficient power supply. Alternatively or additionally there may be a battery interface BS with contacts via which the hazard alarm M can be supplied with power once attached to the auxiliary device R1-R3.

If the hazard alarm M is a smoke alarm for operation on a detector line typically in the commercial sector, then there is no acoustic alarm signaling device, symbolized as a loudspeaker, or button for testing the smoke alarm.

A smoke alarm provided for fire detection in the commercial sector and for operation on a detector line or a detector bus can advantageously be expanded by the inventive auxiliary device R1-R3 by the functionality of automated vicinity monitoring for current-shielding objects and for contamination monitoring of the inlet openings of the smoke alarm.

The following is a summary list of reference numerals and the corresponding structure used in the above description of the invention:

A1-A3 arrangement
AM external contour of the hazard alarm
AR external edge
BAT battery
BS battery terminal
D ceiling
E receiving unit
EV light receiver
FM radio module
KS1, KS2 communications interface
M hazard alarm, smoke alarm, smoke detector
M1-M3 alarm signals
N insect netting
OB object
OF inlet opening
OM optical measuring chamber
P printed circuit board
R1-R3 auxiliary device
RA lateral outer region
S transmitting unit
SA receptacle, base receptacle
SE transmitting/receiving unit
SEM control unit of the hazard alarm
SER evaluation unit of the auxiliary device
SEV light transmitter/receiver
SO base, detector base
SV light transmitter
UR monitored area around the hazard alarm
V contamination

The invention claimed is:

1. An auxiliary device for a hazard alarm constructed as a point type detector, the auxiliary device being a separate unit being attachable to the hazard alarm and monitoring an operation of the hazard alarm, the auxiliary device comprising:

at least one transmitting unit;

at least one receiving unit, said at least one transmitting unit and said at least one receiving unit for detecting objects in a vicinity of the hazard alarm;

an optical scanning device for at least one inlet opening of the hazard alarm; and an evaluation unit connected to said optical scanning device, said evaluation unit emitting a second alarm signal in a event of detected inadmissible contamination.

2. The device according to claim 1, further comprising a central receptacle for receiving the hazard alarm.

3. The device according to claim 2, wherein said central receptacle is a base for receiving the hazard alarm.

4. The device according to claim 1, wherein the device is configured for lateral bordering of the hazard alarm.

5. The device according to claim 1, wherein:

said at least one transmitting unit is one of a plurality of transmitting units; and said at least one receiving unit is one of a plurality of receiving units, said transmitting units and said receiving units distributed in a circumferential direction around the hazard alarm in a lateral outer region located at a distance from the hazard alarm.

6. The device according to claim 5, wherein:

said transmitting units are optical, acoustic or radio-based transmitting units; and said receiving units are optical, acoustic or radio-based receiving units.

7. The device according to claim 6, wherein:

said transmitting units are based on ultrasound, infrared light or microwaves; and said receiving units are based on ultrasound, infrared light or microwaves.

8. The device according to claim 1, wherein:

said optical scanning device has a light transmitter for emitting a highly bundled light beam, said light transmitter is oriented such that its light beam passes the at least one inlet opening at a slight distance;

said optical scanning device has a light receiver for receiving scattered light from contamination from a region of the at least one inlet opening; and said evaluation unit is connected to said light transmitter and to said light receiver, said evaluation unit is adapted to output the second alarm signal if a received signal originating from said light receiver exceeds a predefined minimum level.

9. The device according to claim 1, wherein:

said optical scanning device has a plurality of light transmitters each for transmitting a highly bundled light beam, each of said light transmitters is oriented such that its light beam passes the at least one inlet opening at a slight distance;

said optical scanning device has a plurality of light receivers for receiving scattered light from contamination from a region of the at least one inlet opening; and said evaluation unit is connected to said plurality of light transmitters and said plurality of light receivers, said evaluation unit is adapted to evaluate received signals originating from said light receivers and to output the second alarm signal if a result of an evaluation exceeds a predefined reference value.

10. The device according to claim 9, further comprising at least one of a radio module, a motion sensor, a smoke gas sensor, a temperature sensor, a loudspeaker, an acoustic alarm signaling device, an alarm flash, an emergency light or a battery.

11. The device according to claim 1, further comprising a contact-based and/or wireless communications interface for data communication between a control unit of the hazard alarm and said evaluation unit.

12. The device according to claim 11, further comprising an acoustic alarm signaling device and/or an alarm flash;

wherein said evaluation unit is adapted to receive via said communications interface an alarm signal output in an event of an alarm by the hazard alarm in order to then control said acoustic alarm signaling device and/or alarm flash;

further comprising a checking device for acoustic or electrical checking of said acoustic alarm signaling device and/or a visual checking device for visual checking of the alarm flash;

wherein the device is adapted to repeatedly monitor a functionality of said acoustic alarm signaling device and/or alarm flash; and wherein said evaluation unit is adapted to output a third alarm signal if said acoustic alarm signaling device and/or alarm flash fails a functional test.

13. An auxiliary device for a hazard alarm constructed as a point type detector, the auxiliary device being a separate unit being attachable to the hazard alarm and monitoring an operation of the hazard alarm, the auxiliary device comprising:

a plurality of transmitting units;

a plurality of receiving units, said transmitting units and said receiving units for detecting objects in a vicinity of the hazard alarm;

said transmitting units and said receiving units distributed around the hazard alarm;

an evaluation unit connected to said transmitting units and said receiving units, said evaluation unit is adapted to:

control said transmitting units to output a signal in a vicinity of the hazard alarm;

evaluate in terms of time a respective signal originating from said receiving units and reflected at the objects in the vicinity of the hazard alarm; and output a first alarm signal if a detected object is disposed within a predefined distance around the hazard alarm and if a reflected signal exceeds a predefined minimum level.

14. An auxiliary device for a hazard alarm constructed as a point type detector, the auxiliary device being a separate unit being attachable to the hazard alarm and monitoring an operation of the hazard alarm, the auxiliary device comprising:

a plurality of distributed light transmitters for emitting one light bundle respectively which is directed toward at least one inlet opening of the hazard alarm;

at least one receiving unit, said distributed light transmitters and said at least one receiving unit provided for detecting objects in a vicinity of the hazard alarm;

an evaluation unit;

a contact-based and/or wireless communications interface for data communication between a control unit of the hazard alarm and said evaluation unit; and said evaluation unit is connected to said distributed light transmitters for controlling said distributed light transmitters and is adapted to output a second alarm signal if a light receiving signal transmitted from the hazard alarm via said communications interface, and which originates from a light receiver inside the hazard alarm, falls below a predefined value.

15. A system, comprising:

a hazard alarm constructed as a point type detector; and an auxiliary device according to claim 1 and matched to said hazard alarm in terms of construction and/or connections and is attached to said hazard alarm, said auxiliary device monitoring an operation of the hazard alarm, said at least one transmitting unit and said at least one receiving unit detecting objects in a vicinity of said hazard alarm.

* * * * *